US007533499B2

(12) United States Patent
Daigger et al.

(10) Patent No.: US 7,533,499 B2
(45) Date of Patent: May 19, 2009

(54) ROUGH IN BOX FOR USE IN PROTECTING A PLUMBING DRAIN LINE DURING POURING OF CONCRETE

(76) Inventors: Daniel J. Daigger, 5049 Park Edge Dr., Honor, MI (US) 49640; Rodney K. Moore, 10501 Covey Rd., Honor, MI (US) 49640; Marlow G. Clark, 17650 Gilbert Rd., Arcadia, MI (US) 49613

( * ) Notice: Subject to any disclaimer, the term of this patent is extended or adjusted under 35 U.S.C. 154(b) by 951 days.

(21) Appl. No.: 10/638,885

(22) Filed: Aug. 11, 2003

(65) Prior Publication Data

US 2005/0055916 A1 Mar. 17, 2005

(51) Int. Cl.
*E02D 19/00* (2006.01)

(52) U.S. Cl. ..... 52/169.5; 52/169.7; 52/302.1; 52/302.3; 404/25

(58) Field of Classification Search ..... 52/19, 52/20, 169.7, 169.5; 404/25; 249/188
See application file for complete search history.

(56) References Cited

U.S. PATENT DOCUMENTS

| | | | | |
|---|---|---|---|---|
| 3,593,344 | A | 7/1971 | Logsdon | |
| 3,744,065 | A | 7/1973 | Yavitch | |
| 4,261,598 | A | 4/1981 | Cornwall | |
| 4,338,688 | A | 7/1982 | Petty | |
| 4,742,585 | A | 5/1988 | Logsdon | |
| 4,823,527 | A | 4/1989 | Harbeke | |
| 4,844,655 | A | 7/1989 | Aleshire | |
| 5,399,050 | A | 3/1995 | Jacobus | |
| 5,481,833 | A * | 1/1996 | Williams | 52/19 |
| 5,529,436 | A * | 6/1996 | Meyers | 405/119 |
| 5,586,416 | A | 12/1996 | Hess, III | |
| 6,227,758 | B1 | 5/2001 | Missick | |
| D444,572 | S | 7/2001 | Howe | |
| 6,264,056 | B1 | 7/2001 | King | |
| 6,688,806 | B2 * | 2/2004 | Kuan | 404/25 |
| 6,701,676 | B1 * | 3/2004 | Kompelien | 52/19 |

* cited by examiner

*Primary Examiner*—Jeanette Chapman
(74) *Attorney, Agent, or Firm*—Gifford, Krass, Sprinkle, Anderson & Citkowski, P.C.

(57) ABSTRACT

A form assembly for use with a rough-in floor drain line, extending from a ground location prior to the pouring of a concrete aggregate. A body is constructed of a plasticized material and exhibits a three-dimensional outline with a height, width and depth and an open interior. The body further includes a bottom-most extending and encircling lip and an upper rim edge. The body is positioned so that the open interior surrounds the exposed floor drain line and a volume of a sand aggregate is filled into the open interior over and around the exposed drain. A lid is secured over the rim edge and a plurality of elongated and ground-securing stakes are engaged through apertures associated with the bottom extending said lip, in order to secure the body upon the ground location and to isolate the floor drain line from a volume of encircling and poured concrete.

5 Claims, 3 Drawing Sheets

ROUGH IN BOX FOR USE IN PROTECTING A PLUMBING DRAIN LINE DURING POURING OF CONCRETE

BACKGROUND OF THE INVENTION

1. Field of the Invention

The present invention relates generally to forms used for covering plumbing drain lines. In particular, the present invention discloses a molded and plasticized form (such as may also be constructed of foam) which is secured over a rough-in area in which a plumbing drain line, prior to the pouring of a cement floor, and which isolates the upwardly angled drain line from the encircling cement and prevents the concrete from encroaching within the rough-in area.

2. Description of the Prior Art

The prior art is documented with examples of protection devices and schemes for use with protecting and providing access to floor drain lines and the like. One known example is the construction of boxes, composed of assembled 2"×4" wooden studs, and constructed so as to be placed over a roughed-in floor drain area. The rough-in 2"×4" construction is normally used in order to isolate and protect the rough-in drain at the time of the pouring of a concrete (or cement) floor, and such as is typically used for bathtub, whirlpool, shower and mop sink rough-in drain lines and floor drains.

While providing a somewhat effective solution for isolating and protecting a roughed-in floor drain, such 2"×4" stud constructions suffer from a number of shortcomings, including having to be forcibly disassembled from the encircling poured concrete. The result of this is typically lost time on the jobsite and the inconvenience of manually fashioning such stud constructions.

Other examples drawn from the prior art include Jacobus, U.S. Pat. No. 5,399,050, and which teaches a plastic concrete form for footers including a thermoplastic sidewall, which forms one surface of a concrete form. The sidewall incorporates a drainage tile as an integral unit and two of the sidewalls combined can provide a form for a concrete footer to be poured and which will remain a permanent part of the structure.

Harbeke, U.S. Pat. No. 4,823,527, teaches a plumbing concrete form accessory which includes a relatively large hollow displacement member having a hole in a wall thereof and defining a sleeve about the hole for snugly fitting the outside surface of a pipe. A dissolving type of adhesive is used to adhere the sleeve adjacent a first end of the pipe and a second end of the pipe is mounted to a concrete form by means of a slidable flange which is also adhered to the outside surface of the pipe.

Cornwall, U.S. Pat. No. 4,261,598, teaches a concrete floor embedded coupling for a plastic pipe and which is adapted to be embedded in a concrete floor to form part of a fluid flow path with an interiorly positioned pipe. Finally, Aleshire, U.S. Pat. No. 4,844,655 teaches a structure and method for installation of a drain conduit at a proper elevation with respect to an adjacent surface in a floor, parking lot or the like. The drain conduit is positioned within a trench and support structure (concrete or other solidifiable material) is poured into the trench to support and secure the position of the drain conduit. After the conduit has partially solidified and is capable of supporting the drain conduit, the support structure is removed and is reused in another installation.

SUMMARY OF THE PRESENT INVENTION

The present invention discloses a form assembly for use with a rough-in floor drain line and in order to protect the drain line during the subsequent pouring of a volume of concrete upon a surrounding ground location. As previously described, the form assembly of the present invention provides an improvement over prior art assemblies, including in particular 2"×4" stud assemblies, in that it provides an improved and effective device for isolating and safeguarding (such as maintaining accessibility to) the rough-in drain line during pouring of the concrete, which is typically involved with new construction basements or concrete slabs such as southern housing or commercial/industrial buildings.

As is typically known, the roughed-in (basement or industrial) drain line, and such as is further typically provided for bathtubs, whirlpool tubs, showers, mop sink, floor drains, rough-in lines, and the like, extends from an exposed dirt/earthen ground location, prior to the pouring of a concrete aggregate. The form includes a body, such as may be constructed of a plasticized material, and which exhibits a three-dimensional outline with a height, width and depth defining an open interior.

The body further includes a bottom-most extending and encircling lip and an upper rim edge which receives a three-dimensionally formed and securable lid. The body is positioned so that the open interior surrounds the exposed floor drain line and, in a preferred application, a volume of a sand aggregate is filled into the open interior over and around the exposed drain line.

The lid is then secured over the rim edge and a plurality of elongated and ground-securing stakes are engaged through apertures associated with the lip in order to secure the body upon the ground location and to isolate the floor drain from a volume of encircling and poured concrete. It is also envisioned that the stakes may be integrally formed or otherwise self-contained with the body. In one optional application, it is envisioned that the lid provides an intermediate covering to the form assembly and until such time as the plumber completes the connection associated with the rough-in drain line. It is further contemplated that the form body can be constructed from any of a wide ranging selection of materials and it is further envisioned that the form can either be fixed or removable with respect to the finished concrete floor.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
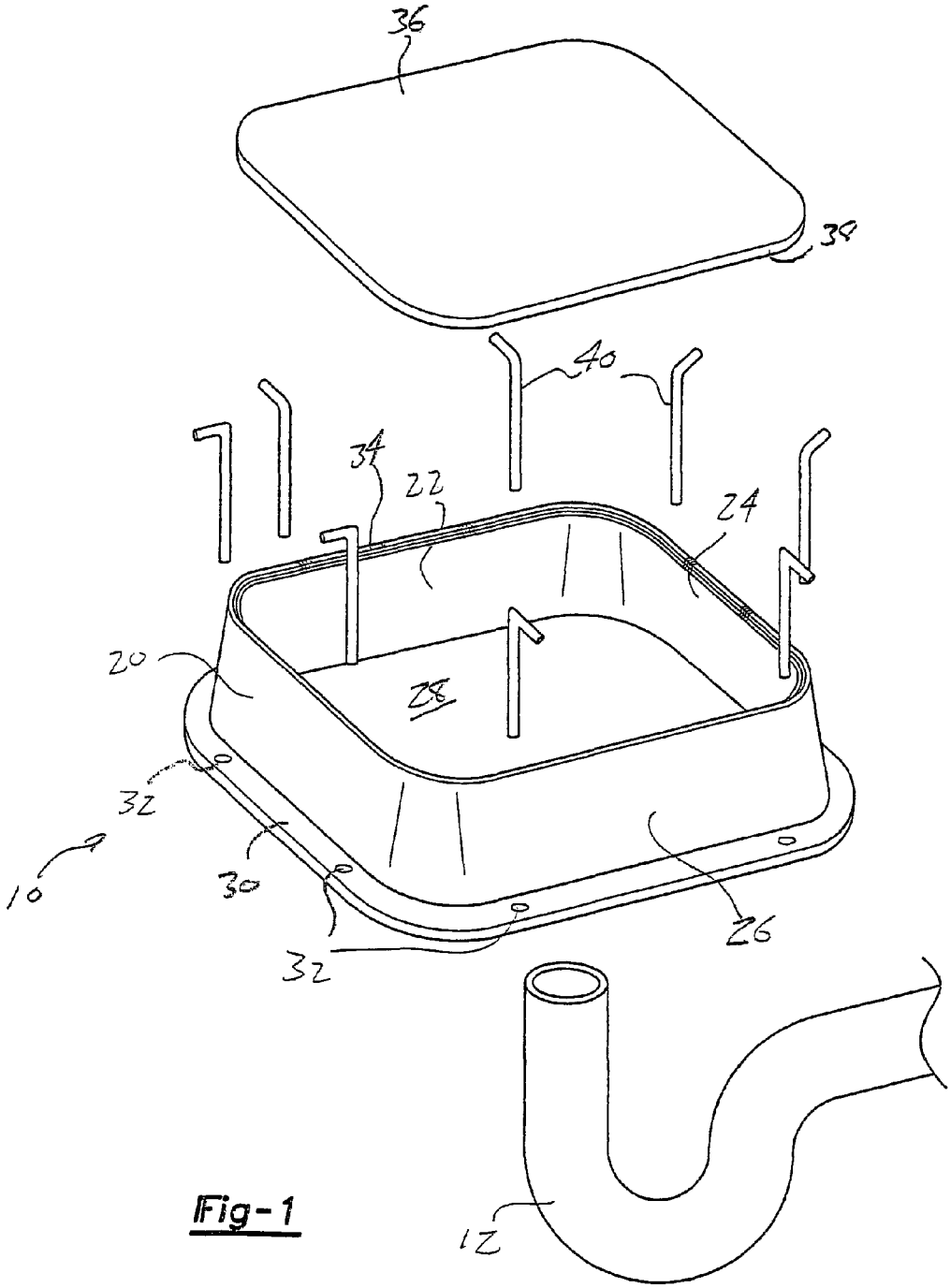
FIG. 1 is an exploded view of the rough-in form assembly according to a preferred embodiment of the present invention.

Referring now to FIG. 1, an exploded view is illustrated generally at 10 of a form assembly for use with a rough-in floor drain line 12. As previously described, and with succeeding reference to FIGS. 2-4, the form assembly 10 exists to protect the drain line 12 during the subsequent pouring of a volume of concrete 14 (FIG. 4), according to any depth, and upon a surrounding earthen ground location 16. As also previously described, the form assembly of the present invention provides an improvement over prior art assemblies, including in particular 2×4 stud assemblies, in that it provides an improved and effective device for isolating and safeguarding the rough-in drain line during pouring of the concrete, and which is typically involved with new construction basements.

Referring again to FIGS. 1-4, the roughed-in (basement or industrial) drain line 12 is further typically provided for bathtubs, whirlpool tubs, showers, mop sink rough-in lines, and the like, and extends in a conventional (typically a P-trap) fashion, terminating in an exposed lip edge 18. The lip edge 18 is preferably contemplated to extend a distance above the level earthen surface of the ground location 16 and it is further envisioned that the exposed end of the drain line 12 may be capped or otherwise enclosed to prevent contaminants from entering into its interior.

The form assembly 10 includes a body, such as may be constructed of a plasticized material, and which exhibits a three-dimensional outline, see upwardly extending and interconnected sides 20, 22, 24 and 26 (FIG. 1) and which, in combination, exhibits a height, width and depth defining an open interior 28. In a preferred variant, the rough-in box form is constructed of a plasticized material, having height, width and depth dimensions (without limitation) of 12"×12"×3½", it being further understood that other dimensions can be incorporated without avoiding the scope of the invention.

As is also illustrated from the drawing figures, the interconnected sides 20, 22, 24 and 26 of the rough-in form 10 each further preferably incorporate an upwardly extending and slightly inwardly inclined taper. The body 10 further includes a bottom-most extending and encircling lip 30, having a plurality of apertures 32 formed therethrough at spaced apart locations.

An upper rim edge is defined at 34, such as is best illustrated in perspective in FIG. 1 and which extends around the four interconnected sides of the body. The rim edge 34 further defines an inward step, as illustrated, and upon which is received a three-dimensionally formed and securable lid 36, the lid further exhibiting such as 12"×12" length by width dimensions, and such as further including a minimal necessary thickness and so that an extending perimeter edge 38 of the lid 36, upon being assembled over the rim 34, is secured in a substantially flush manner (see in particular FIGS. 3 and 4).

Figure 2:
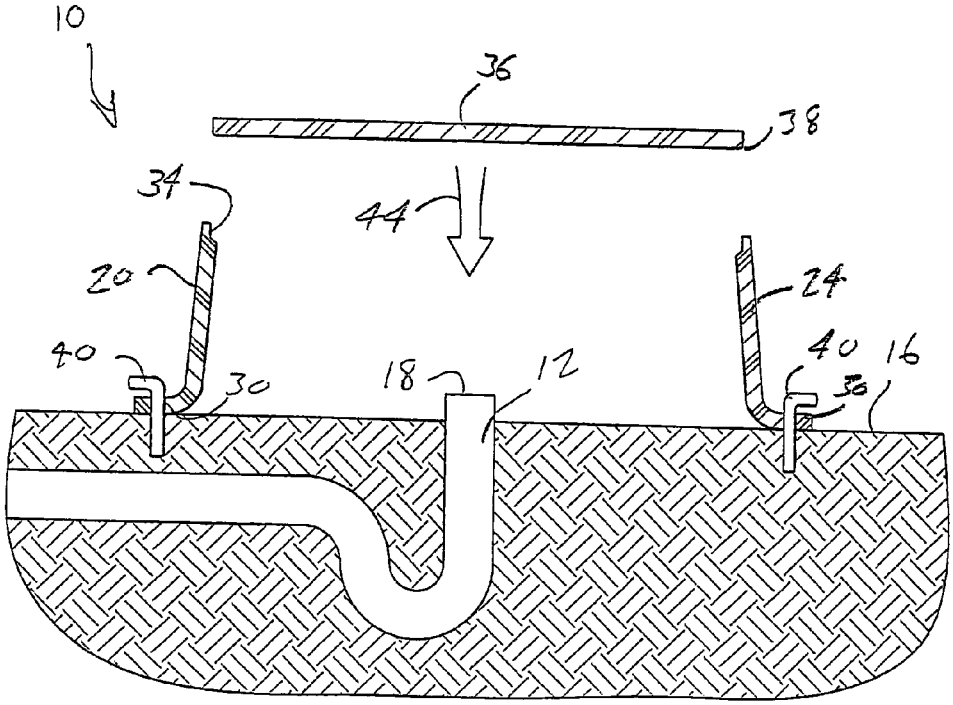
FIG. 2 is a partially exploded and side cutaway environmental view of the form assembly positioned over a roughed-in floor drain line.

In application, and referring first to FIG. 2, the body 10 is positioned so that its open interior 28 surrounds the exposed drain line 12 and its upwardly extending/terminating edge 18. A plurality of ground securing fasteners are provided and are illustrated in one preferred variant as elongated spikes 40 which secure through associated rim apertures 32 and in order to secure the form upon and around the exposed drain line 12.

Figure 3:
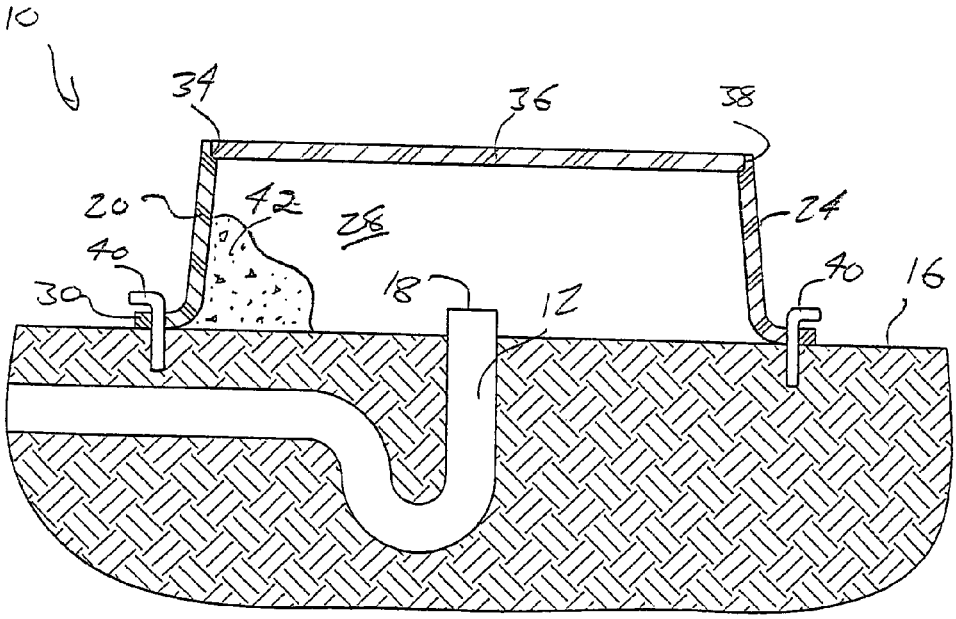
FIG. 3 is a succeeding assembled view of the assembly as substantially illustrated in FIG. 2 and in which a volume of sand aggregate has been packed into the form assembly and the optional lid secured in place.
Figure 4:
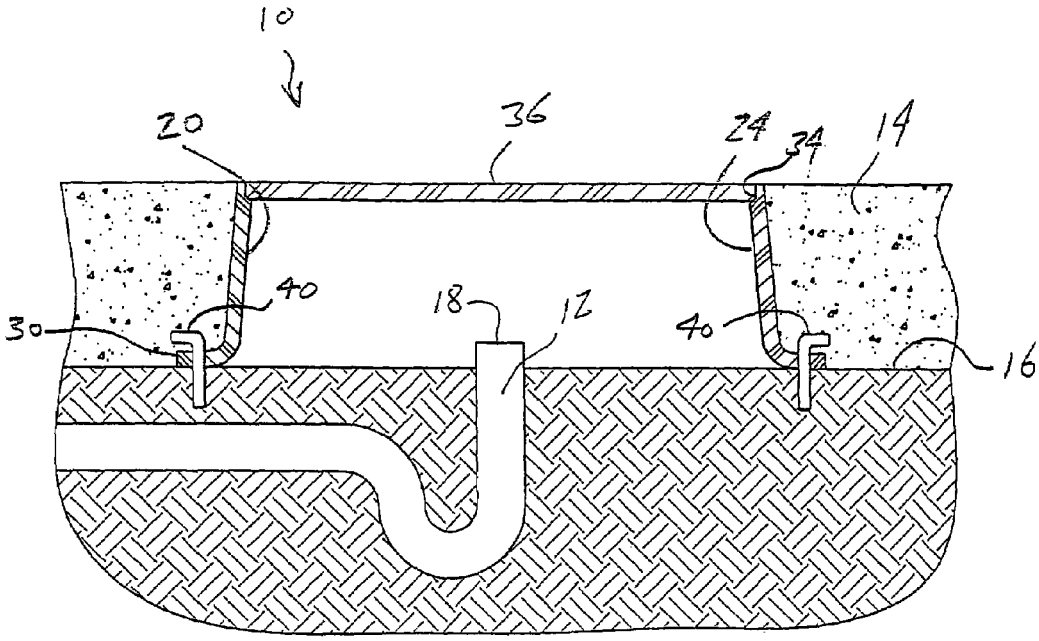
FIG. 4 is a further succeeding and completed view of the rough-in assembly and which illustrates a volume of concrete poured around the form.

In a preferred application, and referring further to FIG. 3, a volume of a sand aggregate 42 is filled into the open interior 28, over and around the exposed drain line 12, in order to provide additional structural integrity to the form assembly 10 and so that, in a worst case scenario, inadvertent contact with poured concrete 14 will not result in the drain line 12 becoming obstructed. It is again understood, however, that the filling of the form interior 28 with the sand aggregate 40 is an optional feature and is not essential to the operation of the present invention.

As illustrated in FIG. 2, the lid 36 and associated edge 38 is then secured over the rim edge 34 (see directional arrow 44) and the plurality of elongated and ground-securing stakes 40 are engaged through the apertures 32, associated with the lip 30, in order to secure the body 10 upon the ground location and to isolate the floor drain line 12 from application of the volume of encircling and poured concrete 14. In a particular application, it is envisioned that the lid 36 provides an intermediate covering to the form assembly, both during and after the pouring of the concrete floor, and until such time as the plumber completes the connection associated with the rough-in drain line 12. It is further contemplated that the form body can be constructed from any of a wide ranging selection of materials, can exhibit any polygonal cross section configuration ranging from a three-sided triangular shape and to a circular shape (exhibiting an infinite number of sides, and it is still further envisioned that the form can either be fixed (permanent with respect to the ground location and poured concrete) or removable with respect to the finished concrete floor.

Having described my invention, other preferred embodiments will become apparent to those skilled in the art to which it pertains, and without deviating from the scope of the appended claims.

We claim:

1. A form assembly for use with a rough-in floor drain line, the drain line extending in exposed fashion from a ground location prior to the pouring of a concrete aggregate, said form assembly comprising:

a body exhibiting a three-dimensional outline with a height, width and depth and which defines an open interior, said body adapted to being positioned so that said open interior surrounds the exposed floor drain line and said body defines a perimeter about said open interior, said body further comprising a plurality of interconnecting sides, each of said sides exhibiting an upwardly directed and inwardly angled taper;

said body further comprising an upper rim edge upon which is received a lid, said rim edge defining an inward step extending around an inner facing perimeter and within which is received an outer perimeter of said lid in a substantially flush fitting manner; and a plurality of ground securing fasteners, engaged through lower-most extremities associated with said body, and in order to secure said body upon the ground location, said lower-most extremities of said body further comprising a bottom-most extending and encircling lip setting upon a surface of the ground location surrounding the drain line;

said body is capable of isolating the floor drain line from the encircling and poured concrete adhering against exteriorly facing surfaces associated with said body.

2. The form assembly as described in claim 1, said ground securing fasteners further comprising a plurality of elongated spikes extending through apertures formed through said lip.

3. The form assembly as described in claim 1, said body having a specified shape and size and further comprising a plasticized material.

4. The form assembly as described in claim 1, said body having a specified shape and size and further comprising a volume of sand aggregate adapted to being filled into said open interior prior to the poured concrete.

5. A form assembly for use with a rough-in floor drain line, the drain line extending in exposed fashion from a ground location prior to the pouring of a concrete aggregate, said form assembly comprising:

a body exhibiting a three-dimensional outline with a height, width and depth and which defines an open interior, said body further comprising a bottom-most extending and encircling lip arid adapted to being positioned so that said open interior surrounds the exposed floor drain line and said body defines a perimeter about said open interior, said body further comprising a plurality of interconnecting sides, each of said sides exhibiting an upwardly directed and inwardly angled taper; and a plurality of elongated and ground securing stakes, engaged through a like plurality of apertures associated with said lip and in order to secure said body upon the wound location;

said body is capable of isolating the floor drain line from the encircling and poured concrete adhering against exteriorly facing surfaces associated with said body.

* * * * *